United States Patent [19]

Afzali-Ardakani et al.

[11] Patent Number: 4,836,106

[45] Date of Patent: Jun. 6, 1989

[54] DIRECT OFFSET MASTER BY RESISTIVE THERMAL PRINTING

[75] Inventors: Ali Afzali-Ardakani, White Plains; Keith S. Pennington, Somer, both of N.Y.

[73] Assignee: International Business Machines Corporation, Armonk, N.Y.

[21] Appl. No.: 115,232

[22] Filed: Oct. 30, 1987

[51] Int. Cl.[4] ..... B41N 3/00

[52] U.S. Cl. ..... 101/467; 400/241.1; 400/696

[58] Field of Search ..... 101/467; 400/241.1, 400/696

[56] References Cited

U.S. PATENT DOCUMENTS

| | | | |
|---|---|---|---|
| 3,125,021 | 3/1964 | Dalton | 101/467 |
| 3,156,183 | 11/1964 | Bach | 101/467 |
| 3,241,996 | 3/1966 | Haas | 101/467 |
| 3,263,604 | 8/1966 | Dalton | 101/467 |
| 3,274,929 | 9/1966 | Newman | 101/467 |
| 3,283,708 | 11/1966 | Yakel | 101/467 |
| 3,452,676 | 7/1969 | Newman | 101/467 |
| 3,483,027 | 12/1969 | Ritzerfeld | 101/401.1 |
| 3,514,597 | 5/1970 | DeHaes | 101/467 |
| 3,552,970 | 1/1971 | Ormsbee | 101/467 |
| 3,650,743 | 3/1972 | Hallman | 101/467 |
| 3,970,002 | 7/1976 | Gaynor | 101/467 |
| 4,525,722 | 6/1985 | Sachdev | 400/241.1 |
| 4,692,044 | 9/1987 | Auiram | 400/241.1 |
| 4,699,533 | 10/1987 | Crowe | 400/241.1 |
| 4,735,879 | 4/1988 | Hotta | 346/76 PH |

FOREIGN PATENT DOCUMENTS

| | | | |
|---|---|---|---|
| 2840220 | 3/1979 | Fed. Rep. of Germany | 400/696 |
| 107611 | 5/1975 | Japan | 101/467 |
| 14804 | 2/1979 | Japan | 101/467 |
| 79788 | 5/1984 | Japan | 400/241.1 |
| 174394 | 10/1984 | Japan | 101/467 |
| 63194 | 4/1985 | Japan | 400/241.1 |
| 2050167 | 3/1987 | Japan | 400/241.1 |
| 2050189 | 3/1987 | Japan | 400/241.1 |
| 2094387 | 4/1987 | Japan | 400/241.1 |

OTHER PUBLICATIONS

IBM; IBM Tech Disc; vol 29, No. 9; Feb. 1987, pp. 3923, 3924.

*Primary Examiner*—Charles Pearson
*Assistant Examiner*—James R. McDaniel
*Attorney, Agent, or Firm*—Douglas W. Cameron

[57] ABSTRACT

This invention describes a direct master for offset printing. The master comprises a thin metal layer, a thermoplastic layer disposed on the metal layer, and a conductive oxide layer evaporated on the metal layer. When this master is subjected to electrical pulses from the styli of a printer, some of the thermoplastic layer diffuses through the oxide layer changing selected regions of the oxide layer to oleophilic regions.

24 Claims, 1 Drawing Sheet

DIRECT OFFSET MASTER BY RESISTIVE THERMAL PRINTING

TECHNICAL FIELD

This invention relates to a direct master for offset printing. The image on the master is formed by the selective application of electrical pulses from the styli of a thermal transfer resistive ribbon printer without using a ribbon.

DESCRIPTION OF THE PRIOR ART

Both resistive ribbon thermal transfer printing and electro-erosion printing are known in the art for providing high resolution, good quality printing, especially of the type that is used in computer terminals and typewriters. Resistive ribbon thermal transfer printing is a type of thermal transfer printing in which a thin ribbon is used. The ribbon is generally comprised of either three or four layers, including a support layer, a layer of fusible ink that is brought into contact with the receiving medium (such as paper), and a layer of electrically resistive material. In a variation, the resistive layer is thick enough to be the support layer, so that a separate support layer is not needed. A thin, electrically conductive layer is also optionally provided to serve as a current return.

In order to transfer ink from the fusible ink layer to the receiving medium, the layer of ink is brought into contact with the receiving surface. The ribbon is also contacted by an electrical power supply and selectively contacted by a thin printing stylus at those points opposite the receiving surface (paper) where it is desired to print. When current is applied via the thin printing stylus, it travels through the resistive layer and causes localized resistive heating, which in turn melts a small volume of ink in the fusible ink layer. This melted ink is then transferred to the receiving medium to produce printing. Resistive ribbon thermal transfer printing is described in U.S. Pat. Nos. 3,744,611, 4,098,117, 4,400100, 4,491,431 and 4,491,432.

The materials used in resistive printing ribbons are well known in the art. For example, the resistive layer is commonly a carbon or graphite-filled polymer, such as polycarbonate. The thin current return layer is a metal, such as Al. The thermally fusible inks are comprised of various resins having a colorant therein, and typically met at about 100 degrees C. Printing currents of approximately 20–30 mA are used in the present, commercially available printers, such as those sold by IBM Corporation under the name QUIETWRITER TM.

Electro-erosion printing is also well known in the art, as exemplified by U.S. Pat. Nos. 2,983,221, 3,786,518, 3,861,952, 4,339,758 and 4,086,853.

A direct master can be easily made by electro-erosion in order to simplify the process by which masters, or plates, are made in conventional offset lithography shops. In such a structure, the electro-erosion recording medium is typically comprised of the support layer, a base layer which is hydrophobic, an Al layer, and an optional overlayer. When the Al layer is electroeroded and the overlayer removed, regions of the Al layer (unwritten areas) and the base layer (written areas) will be exposed. Since the Al layer is hydrophilic, the unwritten areas having Al will attract water but repel organic inks. The written areas of the recording medium, being comprised of the hydrophobic base layer, will repel water but will accept organic based inks. A direct master is thereby produced, since the information to be printed has been successfully mapped onto the master in terms of surface affinity to water and ink.

If the problem of scratching of the Al layer in undesired areas were not present, the substrate-Al layer combination could itself be used for direct master and direct negative applications. For a direct negative, a clear polymer sheet, typically polyesters, can be used as the substrate. Since this is transparent to light while the Al is reflective, a direct negative would be obtained. Also, since the Al is hydrophilic and the polyesters substrate is hydrophobic, a direct master would also be created in principle.

Heretofore, electro-erosion has been used to provide lithographic printing masters, but the lifetimes of these masters in actual use is not as extensive as when the traditional printing plates, or masters, are made using various chemical treatments to prepare a photosensitized plate. One technique for producing offset masters directly is that described in U.S. Pat. No. 4,081,572, where a light beam is used to change selected regions of a hydrophilic polymer layer to a hydrophobic state, thereby creating ink receptive and ink repelling regions. However, such a technique is not as directly usable in standard commercial processes, is expensive, and generally consumes more power. Since a considerable amount of power is required to operate the laser, the overall energy efficiency of this type of system is very low. Also, the system requires additional, high quality optics to concentrate and direct the light beam, or a mask which must be aligned in order to define the patterns of the polymer layer which are to be exposed to the light beam.

U.S. Pat. No. 3,717,464 to Tandy describes a printing master which uses a hydrophobic layer (such as a ZnO resin) which can be converted to a hydrophilic layer by the use of a chemical reagent and exposure to radiation. The invention of this application, however, requires no such chemical reagents. U.S. Pat. No. 4,275,092 discloses a method producing a plate for planographic printing where a oleophilic substrate contacted with a hydrophilic radical polymerizable compound is exposed to actinic ray irradiation.

Printing techniques, such as facsimile printing, often incorporate dyes whose color can be changed in localities where a discharge of current occurs. An example of this is described in U.S. Pat. No. 3,113,512, wherein electrically-induced color changes in a sheet are grouped so as to reproduce the original image scanned by a sending device.

Color changes of the types known in the art using dyes and electrochromic materials do not provide sheets which are very stable over the range of all normal environmental parameters of either temperature or light. In the prior art, it has been desired to provide writing with as low a current as possible and at as high a speed as possible, and for these reasons many of the chemical changes which were used for printing were those types of chemical changes which would occur at low temperatures (typically 100 degrees C., or less). However, the use of such materials is disadvantageous, since ambient conditions are often such that very high temperatures and/or light (such as ultraviolet light) are present, which will cause gradual color changes in the sheets.

It is also desirable to provide a system in which the necessary energy for producing a localized change could be economically provided and delivered in a very efficient manner to the recording medium in which the change is to be made. This would reduce the overall power requirements and make the system more readily applicable for commercial applications. Still further, it would be advantageous if a system could be provided which would have the resolution and print quality equal to or better than that associated with commercial technologies, such as resistive ribbon printing and electro-erosion printing.

A copending application also assigned to IBM Ser. No. 115,453 filed on the same day as this application describes an improved thermal transfer resistive ribbon. Electrical current passes through a resistive layer of the ribbon resulting in localized heating and thereby softening selected regions of an ink layer of the ribbon for transfer of ink to a receiving service.

Another copending application also assigned to IBM Ser. No. 115,471 filed on the same day as this application describes a technique and apparatus for the production of printed circuit boards. The apparatus of this invention is basically resistive ribbon with a metal and resistive layer. Electrical current pulses from the styli of a printer causes heating of the resistive layer which (heating) in turn causes softening of the metal layer which is transferred to a receiving substrate.

Finally, a third copending application also assigned to IBM Ser. No. 115,227 filed on the same day as this application describes an apparatus and technique for the production of direct negatives. Again, as in the above copending application, electrical current pulses from the styli of a printer causes heating of a resistive layer which (heating) results in the softening of an ink layer which in turn is transferred to a conductive layer.

A copending application (Serial No. 729,006) assigned to IBM and filed on April 30, 1985 describes an offset master which is made using electrical energy from the styli of a printer. The apparatus of this copending application basically comprises a support on a substrate layer, a thin electrically conductive layer and a resistive layer. When subjected to electrical energy from the styli, the resistive layer is intensely heated in very small regions. This heat causes those regions to be converted from hydrophilic to oleophilic.

An article in the IBM Technical Disclosure Bulletin, entitled, "Offset Lithographic Plate Maker" by K. S. Pennington and J. M. White, Vol. 27, No. 7A, Dec. 1984, describes a method and apparatus for making a offset lithographic printing master. The master described in this article comprises (1) flexible film substrate, such as conductive film polycarbonate loaded with graphite, (2) a thin aluminum layer film on the underside of the film substrate, and (3) a hydrophobic layer, such as thermoplastic under the aluminum layer. In response to electrical pulses from the stylus of the printer, intense local heating takes place in a hydrophobic layer which is transferred to a hydrophobic substrate to form the master. This article, unlike the present invention, does not teach or suggest the use of conductive oxide layer on the electrographic sheet. Further, unlike the present invention, the hydrophobic layer must be transferred to an offset plate in contact with the electrographic sheet. In addition, the printing master described in the above article does not have a sufficiently long press life. Resolution is also lost in the process of transferring ink from the master to a substrate.

A U.S. Defensive Publication No. T105,002, dated Jan. 21, 1985, discloses a lithographic printing plate which includes a nonconducting hydrophobic substrate layer, an intermediate film of conducting hydrophilic material such as aluminum, and a protective film of relatively hard hydrophilic dialectic material such as aluminum oxide. A printing image is formed by an electro-erosion process which erodes the conductive and dialectic layers to expose hydrophobic substrate. This process, like other well known electro-erosion processes, comes with all the attendant problems of electro-erosion technology such as short press life, scratching and corrosion.

U.S. Pat. No. 3,263,604 discloses use of a mask layer which contains, for example, zinc oxide and a peroxide. The mask on the direct master is used to prevent contamination which occurs when the master is subject to recording currents.

Patent specification No. 1,480,081 in the London Patent Office discloses a printing master produced by spark recording. This master includes a paper or plastic film support on which a layer of metal is deposited thereon. Also included is an optional desensitizing layer deposited on the metal layer. This patent is again another example of electro-erosion technology to make an offset master.

SUMMARY OF THE INVENTION

It is an object of this invention to provide a direct plate for offset printing using a thermal transfer resistive ribbon printer without using a ribbon.

It is also an object of this invention to provide an offset master resistive to ware on an offset press.

It is also an object of this invention to provide a high resolution offset master with the resolution being close to or even smaller than the diameter of the stylus of the printer.

Another object is to provide a master plate which is resistant to atmospheric corrosion.

It is also an object of this invention to have a direct offset plate which is produced by fewer steps without wet chemistry.

Accordingly, this invention provides a direct master for offset printing which comprises: a layer of metal or conductive material, a layer of heat diffusible hydrophobic material which is disposed on the metal layer, and a layer of inorganic resistive material disposed on the heat diffusible hydrophobic material. Selected regions on the surface of the inorganic resistive material are converted to regions that become hydrophobic and ink receptive when the heat diffusible hydrophobic layer diffuses through the resistive material layer when electric current flows from the resistive material through the heat diffusible hydrophobic layer to the conductive layer.

DESCRIPTION OF THE PREFERRED EMBODIMENT

Figure 1:
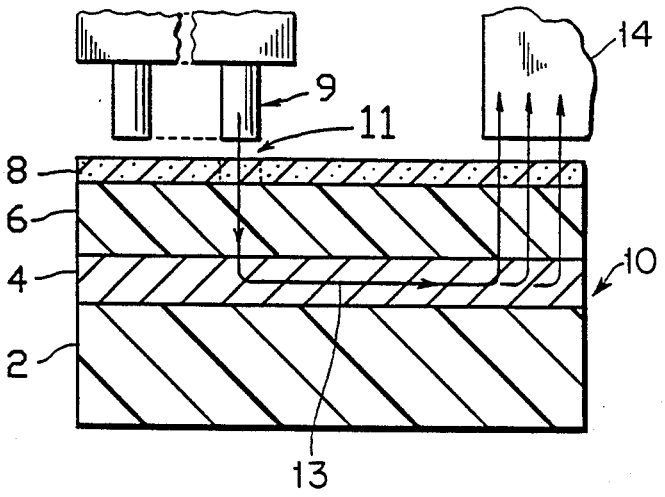
FIG. 1 is a schematic illustration of the direct master used in this invention.

Shown in FIG. 1 is a schematic of the direct master 10 of this invention. The master 10 comprises a paper or plastic substrate 2, a thin layer of metal 4 on the substrate, a thermoplastic material layer 6 coated on the metal layer, and a thin film of conductive oxide 8 evaporated or sputtered on the thermoplastic layer. Shown also are the styli 9 of the thermal transfer resistive ribbon printer. Of course, it is understood that any printing head having multiple styli could be used.

The metal layer can be any conductive material such as aluminum, zinc, indium copper, and tin. The preferred range of thickness for the conductive layer is in the range from 500–10,000 angstroms. The preferred material for the metal layer is aluminum with a preferred thickness of 1000–2000 angstroms. While metal is preferred, any suitable conductive material could be used.

For the thermoplastic layer, such thermoplastic resins as polyvinyl butyral, polyamides and cellulosics could be used. In another embodiment, the thermoplastic layer could also contain conductive particles such as zinc oxide, graphite, nickel coated mica, etc., so that this layer becomes partially conductive with a surface resistivity of 200–1000 ohms/square. While thermoplastic material is preferred, any suitable heat diffusible hydrophobic material could be used. The thermoplastic can also have a small amount of leukodye rendering the images on the offset visible to the eye.

The conductive top layer can be chosen from conductive oxides like tin oxide or indium doped tin oxide or sputtered metal nitrides like chromium nitride. The resistivity of this top layer can be in the range from 100 to 1000 ohms per square, preferably in the range of 200 to 400 ohms/square. While conductive oxides are the preferred materials for the top layer, any suitable inorganic resistive material could be used.

When the master is subjected to electrical pulses from the styli of the printer, current passes from the resistive oxide or nitride layer through the thermoplastic layer and to the conductive layer. This passage of current causes local heating of the thermoplastic layer which melts and diffuses through the oxide layer or top layer to the surface thereof. This diffusion causes selected regions on the surface of the oxide layer or the top layer to be converted to hydrophobic and ink receptive regions. These selected regions make up the image area of the master. The non-image area (metal oxide or nitride layer on which there is no thermoplastic) remains intact and hydrophilic and repels ink. Currents of 10–100 mA (preferably 20–40 mA) is applied which raises the local temperature up to 200–300° C.

Figure 2:
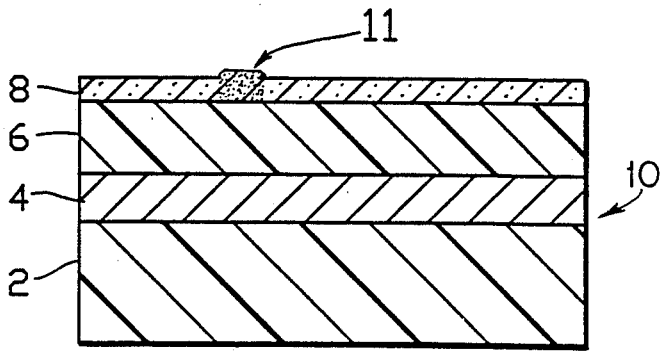
FIG. 2 is a schematic illustration of the direct master after having been subject to electrical current from a printer stylus.

Also, shown in FIG. 2 are the selected regions 11 within and on the surface of the inorganic resistive material 8 (or preferably the tin oxide material). The width (left to right on FIG. 2) of the selected region is in the range of 25 microns. It is these selected regions that are converted to hydrophobic (ink receptive) regions when the heat diffusible hydrophobic material 6 (preferably thermoplastic) diffuses through layer 8. The lines 13 are used to indicate current flow from the styli 9, through part of the direct master to ground electrode 14 as described herein.

As an example of a preferred master, a plastic substrate (e.g. polyethylene trephthalate, PET) with a thickness of 3–5 mils is vacuum deposited with 400–600 Å of aluminum. The aluminum layer is then coated with a 20:80 mixture of polyvinyl butyral (e.g., Monsanto Butyral B76) and conductive zinc oxide. This mixture (thermoplastic layer) has a thickness of 2–5 microns and a resistivity in the range of 400–500 ohms/square. The mixture is then coated by sputtering with a thin layer of conductive tin oxide (indium doped tin oxide). This thin top layer has a thickness of about 1000 Å.

Having thus described our invention, what we claim as new and desire to secure by Letters Patent is:

1. A direct offset master for offset printing, comprising:

(a) a layer of conductive material;

(b) a layer of heat diffusible hydrophobic material, said diffusible material being disposed on said layer of conductive material; and (c) a layer of inorganic resistive material disposed on said heat diffusible hydrophobic material, selected regions on the surface of said inorganic resistive material being converted to hydrophobic regions when said heat diffusible hydrophobic layer diffuses through said resistive material layer when electrical current flows through said resistive material layer, through said layer of heat diffusible hydrophobic material and to said layer of conductive material.

2. A direct offset master as recited in claim 1, wherein said conductive layer comprises aluminum.

3. A direct offset master s recited in claim 1, wherein said conductive layer comprises tin.

4. A direct offset master as recited in claim 1, wherein said conductive layer comprises indium.

5. A direct offset master as recited in claim 1, wherein said heat diffusible hydrophobic layer comprises a thermoplastic material.

6. A direct offset master as recited in claim 5, wherein said thermoplastic material has an amount of leukodye therein.

7. A direct offset master as recited in claim 5, wherein said heat diffusible hydrophobic layer comprises a mixture of thermoplastic and conductive particles.

8. A direct offset master as recited in claim 7, wherein said conductive particles is zinc oxide.

9. A direct offset master as recited in claim 1, wherein said inorganic resistive material is a conductive oxide.

10. A direct offset master as recited in claim 9, wherein said conductive oxide is doped tin oxide.

11. A direct offset master as recited in claim 9, wherein said conductive oxide is tin oxide.

12. A direct offset master as recited in claim 1, wherein said inorganic resistive material is a metal nitride.

13. A direct offset master as recited in claim 12, wherein said metal nitride is chromium nitride.

14. A direct offset master as recited in claim 1, further comprising:

a substrate layer on which said conductive layer is coated.

15. A direct offset master as recited in claim 14, wherein said substrate layer is plastic.

16. A direct offset master as recited in claim 14, wherein said substrate layer is paper.

17. A direct offset master for offset printing on which an image is formed by using a thermal transfer printer without a ribbon, which printer has a plurality of styli for generating electrical pulses, said master comprising:

(a) a layer of metal;

(b) a layer of thermoplastic material disposed on said metal layer; and (c) a layer of conductive metal oxide disposed on said thermoplastic material, selected regions on the surface of said oxide layer being converted to hydrophobic regions when some of said thermoplastic layer diffuses through said oxide layer when, in response to electrical pulses from said styli, an electrical current flows through said oxide layer, through said thermoplastic layer and to said layer of metal.

18. A direct offset master as recited in claim 17, wherein said thermoplastic layer has an amount of leukodye therein.

19. A direct offset master as recited in claim 17, wherein said metal is aluminum.

20. A direct offset master as recited in claim 17, wherein said thermoplastic material is polyvinyl butyral.

21. A direct offset master as recited in claim 17, wherein said conductive oxide is doped tin oxide.

22. A direct offset master for offset printing on which an image is formed by using a thermal transfer printer without a ribbon, which printer has styli for generating electrical pulses, said master comprising:

(a) a substrate layer of plastic;

(b) a layer of aluminum on said substrate layer;

(c) a layer of thermoplastic material having an amount of leukodye, said material being coated on said layer of aluminum; and (d) a layer of tin oxide sputtered on top of said layer of thermoplastic material, selected regions on the surface of said film being converted to hydrophobic regions when some of said thermoplastic layer diffuses through said film when, in response to electrical pulses from said styli, electrical current flows through said oxide layer, through said thermoplastic layer and to said aluminum layer.

23. A direct offset master as recited in claim 22, wherein the layer of aluminum has a thickness in the range from 500 to 2000 angstroms.

24. A direct offset master as recited in claim 22, wherein the tin oxide layer has a resistivity in the range from 200 to 800 ohms per square.

* * * * *